US005522335A

United States Patent [19]

Veronesi et al.

[11] Patent Number: 5,522,335

[45] Date of Patent: Jun. 4, 1996

[54] COMBINED AZIMUTHING AND TUNNEL AUXILLARY THRUSTER POWERED BY INTEGRAL AND CANNED ELECTRIC MOTOR AND MARINE VESSEL POWERED THEREBY

[75] Inventors: Luciano Veronesi; James A. Drake, both of Blawnox/O'Hara Township, Pa.

[73] Assignee: Westinghouse Electric Corporation, Pittsburgh, Pa.

[21] Appl. No.: 381,619

[22] Filed: Jan. 30, 1995

[51] Int. Cl.[6] ..... B63H 25/46

[52] U.S. Cl. ..... 114/151; 440/6

[58] Field of Search ..... 114/151, 147; 440/54, 38, 6

[56] References Cited

U.S. PATENT DOCUMENTS

| | | | |
|---|---|---|---|
| 2,302,795 | 11/1942 | Noble | 440/54 |
| 2,699,138 | 1/1955 | Dyer . | |
| 3,056,374 | 10/1962 | Linhardt . | |
| 3,550,547 | 12/1970 | Pleuger . | |
| 4,075,971 | 2/1978 | Reginensi et al. . | |
| 4,208,978 | 6/1980 | Eller | 114/151 |
| 4,274,827 | 6/1981 | Catsburg . | |
| 5,101,128 | 3/1992 | Veronesi et al. . | |
| 5,185,545 | 2/1993 | Veronesi et al. . | |
| 5,220,231 | 6/1993 | Veronesi et al. . | |
| 5,252,875 | 10/1993 | Veronesi et al. . | |

*Primary Examiner*—Stephen Avila

[57] ABSTRACT

An auxiliary thruster for a marine vessel. The auxiliary thruster includes a submersible propulsion unit which has a shroud with a propeller rotatably mounted therein. A canned electric motor is mounted between the propeller and the shroud for rotating the propeller to create thrust. A propulsion unit deploying and rotating mechanism is mounted on the hull and on the propulsion unit. The propulsion unit deploying and rotating mechanism is operable to extend the propulsion unit out of the hull and retract it into the hull and to rotate the propulsion unit to direct the thrust generated thereby in any desired direction when the thruster is in the deployed position. When the thruster is retracted, it is positioned with a tunnel extending transversely through the hull. Rotation of the propeller while in the retracted position generates laterally directed thrust through the tunnel.

22 Claims, 6 Drawing Sheets

COMBINED AZIMUTHING AND TUNNEL AUXILLARY THRUSTER POWERED BY INTEGRAL AND CANNED ELECTRIC MOTOR AND MARINE VESSEL POWERED THEREBY

BACKGROUND OF THE INVENTION

1. Field of the Invention

This invention relates to an auxiliary thruster for a maxine vessel and, more particularly, to an auxiliary thruster for a marine vessel that is powered by an integral canned electric motor.

2. Field of the Invention

Marine vessels of all types have utilized auxiliary thrusters to assist in low speed ship maneuvering, station keeping and docking. The most common types of auxiliary thrusters are tunnel thrusters and deployable azimuthing thrusters.

The tunnel thruster is typically a bevel gear driven propeller located in a tunnel extending transversely through the huh of the ship below the water line. The tunnel is typically near the bow or stern of the vessel. When the tunnel thruster is operated, it produces laterally directed thrust in either direction through the tunnel.

Azimuthing thrusters are typically permanently affixed to the hull or deployable out of a cavity in the bottom of the vessel's hull. A conventional azimuthing thruster also uses a gear driven propeller which produces thrust for ship propulsion. The azimuthing thruster can be rotated to direct thrust in any direction for more precise control of the vessel for maneuvering and station keeping. It is desirable that azimuthing thrusters that extend below the hull of the vessel also be retractable into the hull. When the azimuthing thruster extends below the bottom of the vessel, it could be damaged if it strikes the sea bottom when the vessel enters shallow water.

Conventional auxiliary thrusters are powered by electric motors or gasoline or diesel engines. The motor or engine drives the propeller of the thruster through a gear box. This necessitates complex gearing mechanisms for transmitting power from the drive unit to the propeller. In addition, each such auxiliary thruster typically requires its own engine or motor to provide power. When coupled with the space needed for the main power plant for the vessel, space needed for the auxiliary power plants can drastically reduce the amount of usable space in the vessel. There is a need for an auxiliary thruster which can operate as both an azimuthing or tunnel thruster and which is powered by an integral canned electric motor.

SUMMARY OF THE INVENTION

This invention meets the aforementioned needs. The marine vessel auxiliary thruster of this invention includes a submersible propulsion unit having a motive means mounted therein to generate thrust to prepare the vessel. The motive means may be an electric motor or a hydraulic motor mounted in the submersible propulsion unit to power a propeller also mounted in the propulsion unit. The motive means may be connected to the vessel so that electrical current, hydraulic fluid or fuel is supplied to the motive means. Alternatively, the fuel source, electrical source, or hydraulic fluid source may be mounted in the propulsion unit.

In one embodiment, the motive means is a canned electric motor mounted to rotate a propeller operatively associated with the motor. The propulsion unit includes a shroud having a water inlet and a water outlet. A shaft is mounted in the center of the shroud between the inlet and outlet. A propeller, having a hub that is rotatably mounted on the shaft is positioned for rotation inside the shroud. A canned electric motor is mounted on the propeller and the shroud. The canned electric motor includes a sealed rotor and a sealed stator. The stator is spaced away from the rotor but is electromagnetically coupled to the rotor to form an electric motor. The stator is connected to a source of electrical current. When the stator is energized, an electromagnetic field is generated that rotates the rotor, thereby rotating the propeller. When the unit is submerged, the rotation of the propeller pumps water through the shroud from the water inlet to the water outlet, thereby creating thrust.

The propulsion unit is connected to a propulsion unit deploying and rotating mechanism. The deploying and rotating mechanism is also attached to the hull of the vessel. The deploying and rotating mechanism is operable to move the propulsion unit to extend it out of and retract it into the hull of the vessel. The mechanism also operates to rotate the propulsion unit about an axis that is generally perpendicular to the shaft so as to direct thrust in any desired direction in a plane generally perpendicular to the axis of the shaft.

In one embodiment, the propulsion unit deploying and rotating mechanism includes an elongated mast. One end of the mast is connected to the top portion of the shroud and is oriented so that the mast is generally perpendicular to the shaft. The other end of the mast extends into the hull of the vessel. The propulsion unit deploying and rotating mechanism is operable to longitudinally extend the propulsion unit out of the bottom of the huh and retract it back into the hull. When the mast is retracted the propulsion unit is received into a recess in the bottom of the hull for storage.

In one embodiment, a tunnel extends transversely through the hull. The ends of the tunnel extend to the side of the hull and are in communication with the water in which the vessel is floating. The recess into which the propulsion unit is received is positioned so that the propulsion unit is aligned with the tunnel in a manner so that rotation of the propeller pumps water through the tunnel to generate lateral thrust. The thrust is useful in maneuvering the vessel laterally such as during docking. When the tunnel thruster is in bow portion of the vessel, the propulsion unit would operate as a bow thruster.

When the propulsion unit is deployed, it extends downward from the bottom of the vessel. When so deployed, the device may be used as an azimuthing thruster to direct thrust in any desired direction in a plane parallel to the direction of travel of the vessel. A gear box is provided for rotating the mast about its longitudinal axis and maneuvering it in the desired position. Rotation of the mast also rotates the propulsion unit so that thrust may be directed at any desired angle in a plane perpendicular to the longitudinal axis of the mast.

The electrical connection of the stator to a source of electrical energy must be made to that rotation of the mast is not restricted. At least one pair of electrically connected slip rings are used. The stationary ring of each pair of slip rings is electrically connected directly to the source of electrical energy, such as a generator. The second ring of the pair which is secured to an rotatable with the mast, is electrically connected directly to the stator. In that manner, the electrical connection is made without interfering with the rotation of the mast.

The beating assembly may include beatings that are cooled and lubricated using water or oil. If water cooled beatings are used, water may be circulated through openings between the hub and the shaft that are in communication with the water that is being pumped by the propeller. If oil is used to cool and lubricate the beatings, any openings between the hub and shaft are sealed. Oil is gravity supplied to the beatings from a reservoir that is positioned above the level of the beatings when the unit is fully retracted. A supply pipe carries oil from the reservoir to the beatings and a return line runs from the bearings to an overflow port at the level of the reservoir. In that manner, a constant head of oil pressure may be maintained in the beatings. The connection of the oil supply and return lines to the thruster is through a rotary joint so that rotation of the mast and propulsion unit is not restricted.

The thruster may be mounted in a frame for attachment in the hull of the vessel. The frame provides stable support for the device. It also permits the device to be removed as a unit for repair or replacement.

It is an object of this invention to provide an auxiliary thruster for a marine vessel, said thruster being powered by an integral canned electric motor.

It is another object of this invention to provide a thruster for a marine vessel that is extendable to a position outside the hull of the vessel for use as an azimuthing thruster.

It is a further object of this invention to provide a thruster for a marine vessel that can be used within the hull as a tunnel thruster to provide lateral thrust and which can be deployed external to the hull to direct thrust in any desired direction parallel to the plane in which the vessel is moving.

These and other objects will be apparent from the following description of the preferred embodiments with references to the drawings.

DETAILED DESCRIPTION OF THE PREFERRED EMBODIMENT

Figure 1:
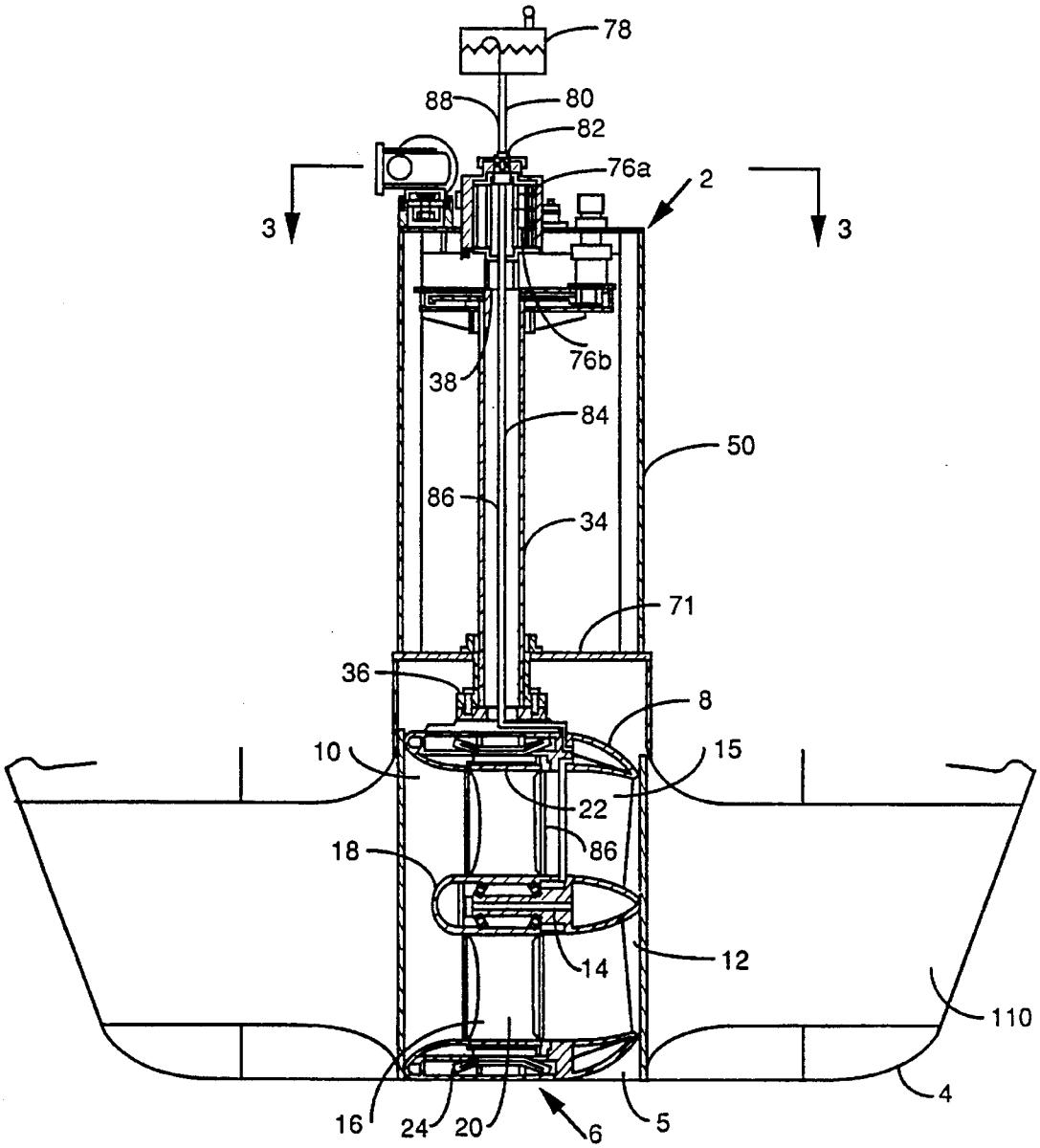
FIG. 1 is a longitudinal sectional view of the auxiliary thruster of this invention showing the propulsion unit in the retracted position.
Figure 2:
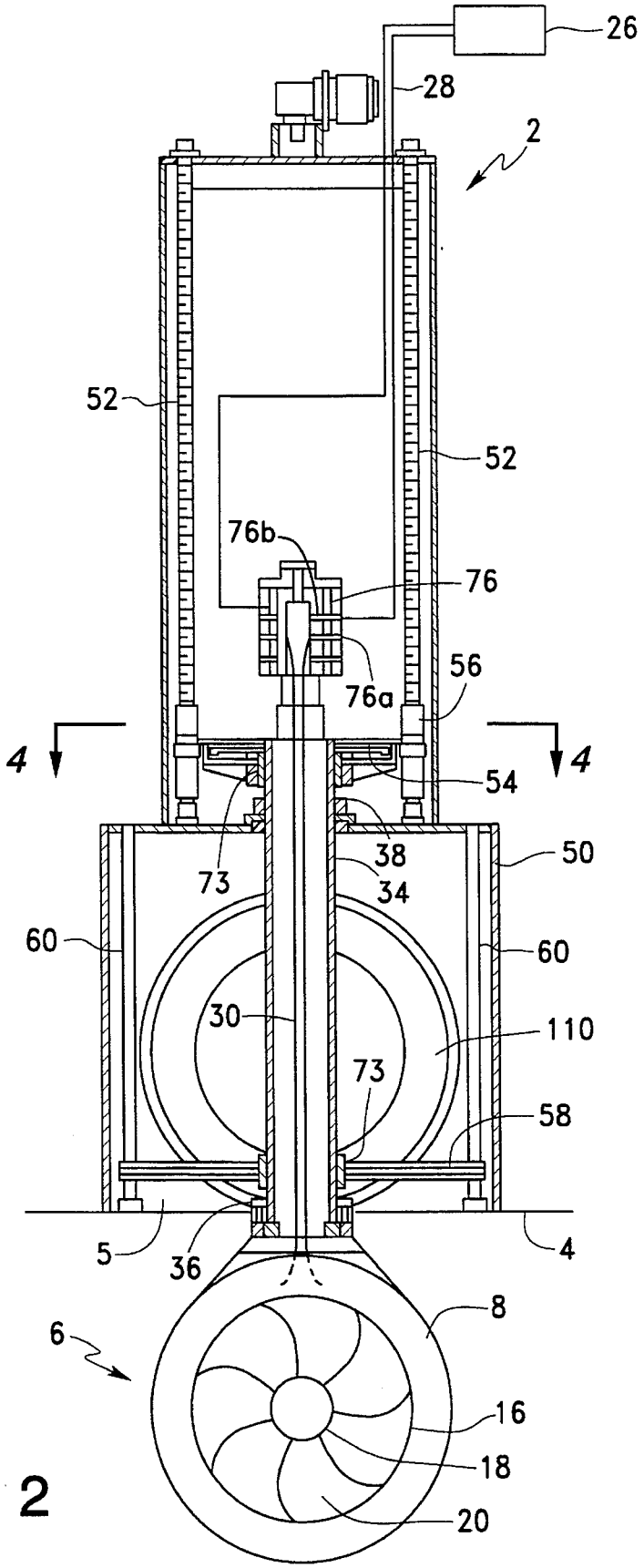
FIG. 2 is a longitudinal section view of the auxiliary thruster of this invention showing the propulsion unit in the deployed position.

Referring to FIGS. 1 and 2, there is shown a preferred embodiment of the auxiliary thruster 2 of this invention. Auxiliary thruster 2 is mounted in the hull 4 of a marine vessel. Hull 4 is provided with a recess 5 therein.

Auxiliary thruster 2 includes a submersible propulsion unit 6. Propulsion unit 6 includes generally cylindrical shroud 8 having a water inlet 10 and a water outlet 12. A shaft 14 is mounted in the center of shroud 8. Shaft 14 is preferably supported within shroud 8 having a plurality of vanes 15 connected between shaft 14 and shroud 8. Propeller 16 includes a central hub 18 and a plurality of outwardly extending blades 20 spaced around hub 18. In a preferred embodiment, four blades 20 are provided. Hub 18 is rotatably mounted on shaft 14. In a preferred embodiment, propeller 16 is positioned on shaft 14 so that vanes 15 are positioned between the blades 20 and outlet end 12 of shroud 8. Five vanes 15 are provided in a preferred embodiment.

Propulsion unit 6 further includes a hermetically sealed induction or synchronous motor rotor 22 mounted around the perimeter of blades 20 of propeller 16. Rotor 22 is sealed by a rotor can in a manner known to those skilled in the an. A hermetically sealed motor stator 24 is mounted within shroud 8. Stator 24 is sealed by a stator can in a manner known to those skilled in the art. Stator 24 is spaced away from rotor 22 but is electromagnetically coupled thereto to form a canned electric motor. It will be appreciated that the electric motor is integral with propulsion unit 6. Electrical energy is supplied to stator 24 from an external source of electrical current. In a preferred embodiment, the external source of electrical energy is a generator 26 mounted within the hull 4 of the vessel. Generator 26 may be powered by one or more gasoline or diesel engines or other suitable driving means known to those skilled in the art. For example, generator 26 may be powered by the main power plant of the vessel. Generator 26 is electrically connected to stator 24 by electrical leads 28, 30.

Figure 5:
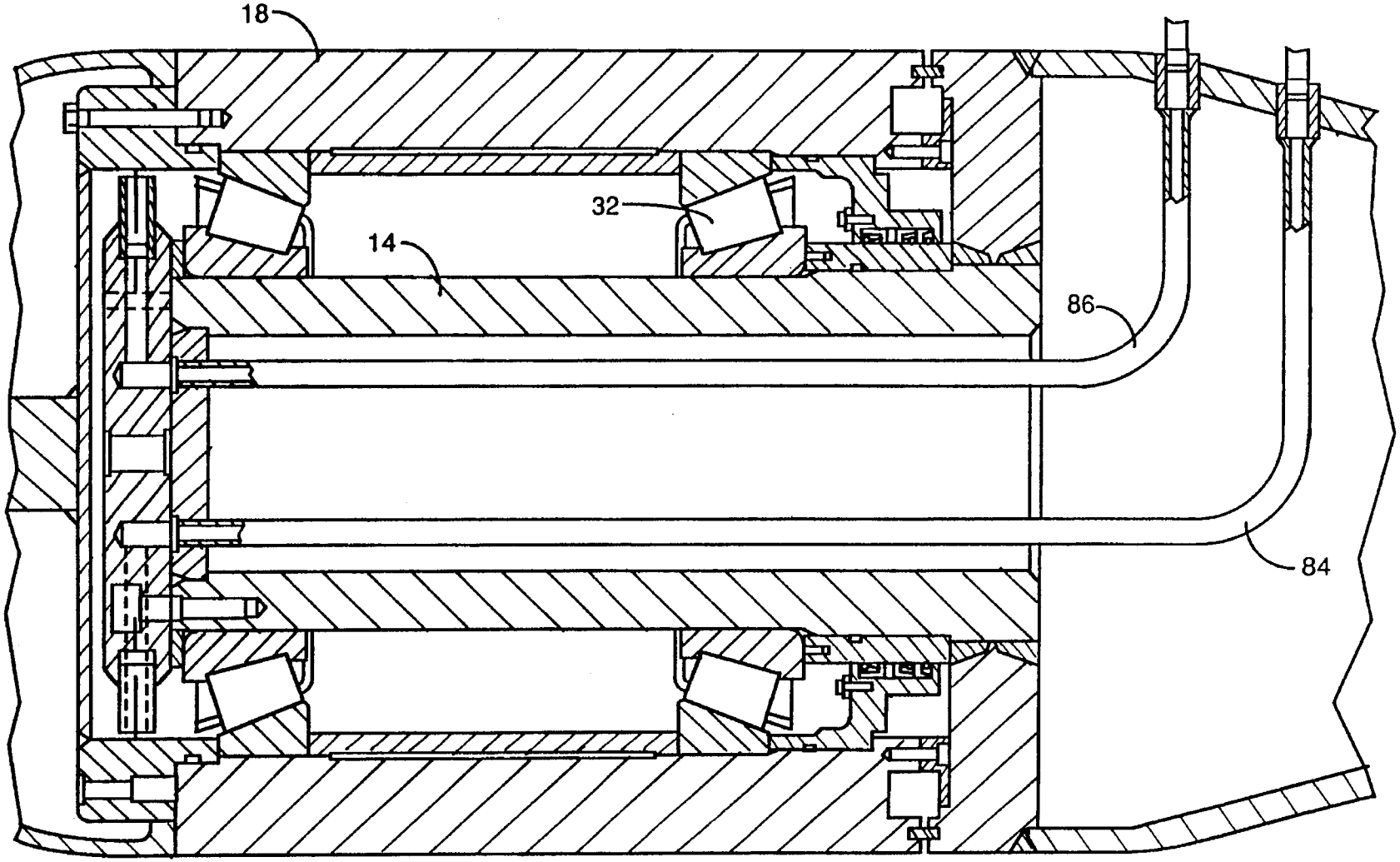
FIG. 5 is a partial sectional view of a portion of the propulsion unit of this invention.

A bearing assembly 32 is mounted between shaft 14 and hub 18 to rotatably support propeller 16. Bearing assembly 32 is preferably made up of tapered roller bearings in an oil filled chamber (FIG. 5). However, it will be appreciated that water cooled bearings could be used, with water from within the shroud being circulated therethrough by propeller 16 to provide cooling and lubrication.

An alternative propulsion unit for use with this invention is shown in U.S. Pat. No. 5,220,231, the disclosure of which is incorporated herein by reference.

In a preferred embodiment, propulsion unit 6 is mounted on elongated, tubular mast 34 for deployment out of and retraction into hull 4. The bottom end 36 of a tubular, elongated mast 34 is mounted to a top portion of shroud 8 of propulsion unit 6. The top end 38 of mast 34 extends generally upwardly from propulsion unit 6 and into hull 4. Mast 34 is mounted such that its longitudinal axis is generally perpendicular to the longitudinal axis of shaft 14. It will be appreciated, however, that propulsion unit 6 could be mounted in other suitable ways that enable deployment out of and retraction into hull 4. For example, propulsion unit 6 could be mounted on one or more cantilevered beams or on a plurality of vertically extending masts or beams.

In a preferred embodiment, a frame 50 is mounted inside hull 4. Top end 38 of mast 34 extends into frame 50. A pair of power screws 52 are mounted in the frame generally parallel to mast 34. Power screws 52 are of a ball-type power screws of a type known to those skilled in the art. Top end 38 of mast 34 is provided with mounting plate 54. Mounting plate 54 is mounted to a pair of riders 56, which are mounted on power screws 52. Rotation of power screws 52 moves riders 56 upwardly or downwardly longitudinally along the power screws 52, as desired, which in turn also moves mast 34 upwardly or downwardly. When riders 56 are at the top position on power screws 52, such as shown in FIG. 1, mast 34 and propulsion unit 6 are fully retracted into hull 4. In the retracted position, propulsion unit 6 is received into recess 5 of hull 4. When riders 56 are at the bottom of power screws 52, such as shown in FIG. 2, mast 34 and propulsion unit 6 are in the fully deployed position. In the deployed position, propulsion unit 6 extends outside the hull 4 of the vessel.

In a preferred embodiment, yoke 58 is mounted onto mast 34 adjacent to bottom end 36. Yoke 58 is also slidably mounted to hull 4 on longitudinally extending columns 60. Yoke 58 provides lateral support for auxiliary thruster 2 during operation, and during deployment and retraction thereof.

Figure 3:
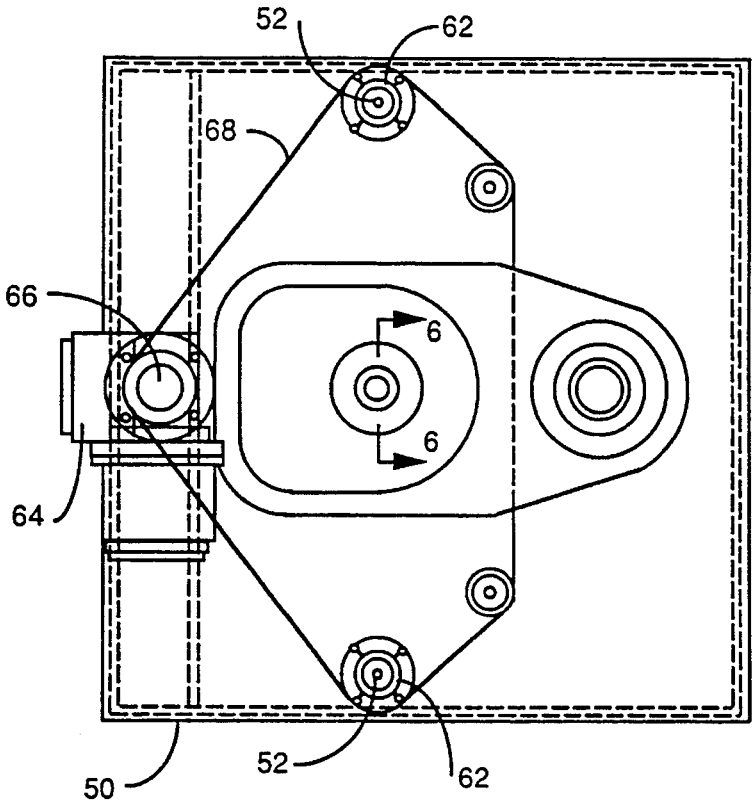
FIG. 3 is a plan view of the auxiliary thruster of this invention.

Referring to FIG. 3, there is shown the preferred embodiment for the mechanism for effecting operation of power screws 52. The top end of each power screw 52 is provided with a rotation sprocket 62. An electrically powered reversible gear box 64, having a drive sprocket 66, is mounted on frame 50. A drive chain 68 operatively connects rotation sprockets 62 and drive sprocket 66. Rotation of drive sprocket 66 moves chain 68 thereby turning rotation sprockets and power screws 52 connected thereto. Reversing the direction of rotation of drive sprocket 66 permits the auxiliary thruster 2 to be retracted or deployed as desired. Controls for activating and reversing gear box 64 are preferably located on the bridge of the vessel and are connected to gear box 64 in a manner known to those skilled in the art. It will be appreciated that direct gear drive arrangements may be used as alternatives to a chain drive for activating power screws 52.

Figure 4:
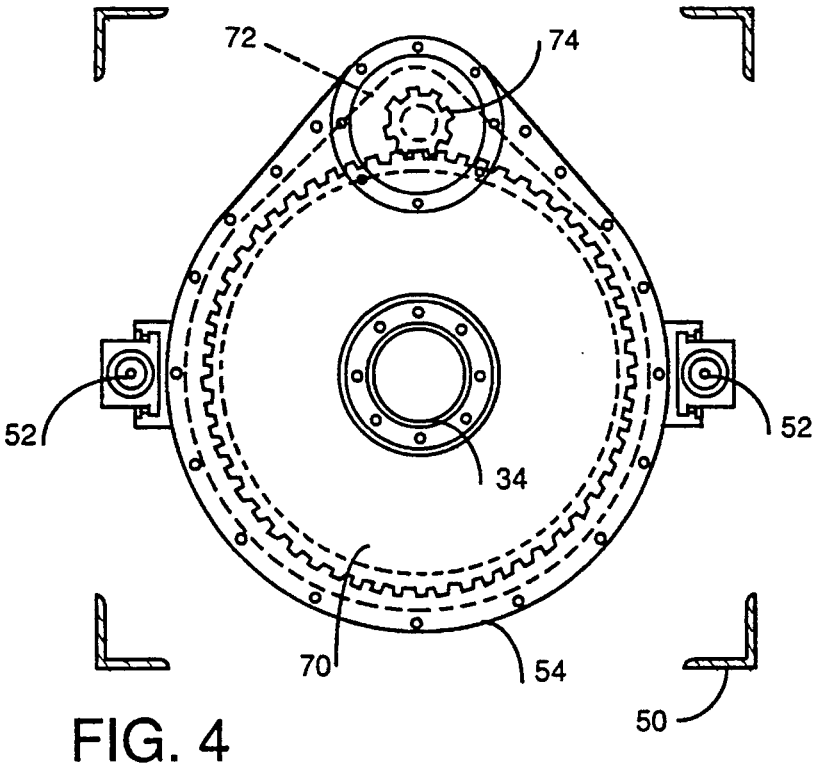
FIG. 4 is a cross-sectional view of the auxiliary thruster of this invention taken through line 4—4 of FIG. 2.

In a preferred embodiment, auxiliary thruster 2 is mounted for rotation about its longitudinal axis so that the propulsion unit 6 may be rotated to provide thrust in any desired direction in a plane generally perpendicular to the longitudinal axis of mast 34. The preferred mechanism for rotating auxiliary thruster 2 is shown in FIG. 4. A rotation gear 70 is mounted on the top end 38 of mast 34. Electrically powered, reversible rotation gear box 72 is mounted on mounting plate 54. Gear box 72 includes output gear 74 operatively positioned to mesh with rotation gear 70 such that rotation of output gear 74 drives rotation gear 70 thereby rotating mast 34 and propulsion unit 6 about the longitudinal axis of mast 34. That mechanism permits the thruster 2 to be repeatedly rotated 360° about its axis. Controls for activating and reversing gear box 72 are preferably located on the bridge of the vessel.

Referring to FIGS. 1 and 3, a floating seal 71 seals the opening in the hull 4 through which mast 34 passes. Bearings 73 are mounted between mast 34 and yoke 58 and between mast 34 and hull 4 to rotationally support mast 34.

Because the auxiliary thruster 2 can be rotated repeatedly about its axis, the electrical connection between the generator 26 and stator 24 must be made in a manner that does not restrict rotation of the thruster 2. Referring again to FIGS. 1 and 2, a plurality of pairs of electrically connected slip rings 76 are mounted onto the top end 38 of mast 34. Each pair of slip rings 76 includes a first ring 76*a* and a second ring 76*b*. First ring 76*a* fixedly mounted with respect to the rotation of mast 34. First ring 76*a* is electrically connected to generator 26 by electrical lead 28. Second ring 76*b* is mounted on mast 34 for rotation therewith and is electrically connected to stator 24 by electrical lead 30 extending through mast 34. First ring 76*a* and second ring 76*b* are electrically connected to one without disrupting the integrity of the electrical connection therebetween.

Referring to FIGS. 1 and 5, in a preferred embodiment, bearing assembly 32 is an oil cooled and lubricated beating which is sealed with the chamber between shaft 14 and hub 18. The chamber is filled with oil that is gravity fed from an oil reservoir 78 positioned above the level of the bearing assembly 32. A first supply pipe 80 connects oil reservoir 78 to rotary joint 82 mounted on top end 38 of mast 34. Second supply pipe 84 connects rotary joint 82 with the chamber in which bearing assembly 32 is located. First return pipe 86 connects the chamber in which bearing assembly 32 is located and rotary joint 88. Second supply pipe 84 and first return pipe 86 extend longitudinally through mast 34, into shroud 8 of propulsion unit 6. Pipes 84.86 then extend generally parallel to vanes 16 and into shaft 14, as is shown more clearly in FIG. 5. Referring again to FIG. 1, rotary joint 88 is connected to second return pipe 90, which is open ended and extends above the oil level in the reservoir. thereby forming an overflow. The position of reservoir 78 maintains a generally constant head of oil pressure within the chamber in which bearing assembly 32 is located. Referring again to FIG. 5, in a preferred embodiment, first return pipe 86 is connected to the chamber in which bearing assembly 32 is located at a position above the level of second supply pipe 84, thereby ensuring that a constant level of oil is maintained in the chamber in which bearing assembly 32 is located.

Because mast 34 can be continuously rotated about its longitudinal axis, the connection rotary joints 82, 88 must provide the desired connections without interfering with rotation.

Figure 6:
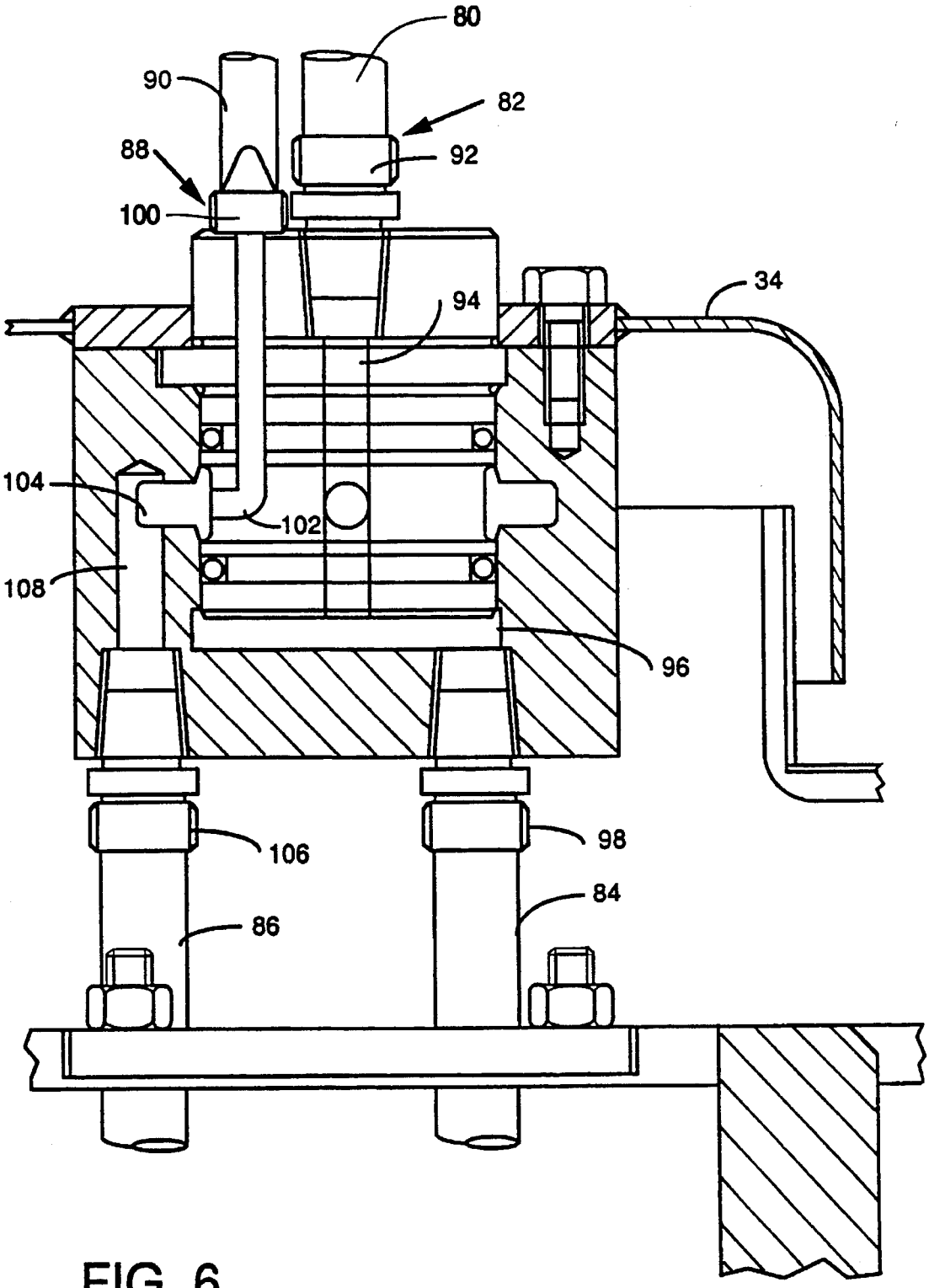
FIG. 6 is a partial sectional view of a portion of this invention taken through line 6—6 of FIG. 3.

Referring to FIG. 6, there is shown preferred embodiments of rotary joints 82 and 88. Rotary joint 82 includes a first supply connector 92 fixedly mounted on mast 34 with respect to rotational movement of mast 34. First supply connector 92 is preferably mounted coaxially with mast 34. First supply pipe 80 is connected to first supply connector 92. Bore 94 extends through a portion of mast 34 and connects first supply connector 92 with circular chamber 96. Circular chamber 96 is in communication with second supply connector 98. Second supply connector 98 is mounted for rotation with mast 34. Second supply pipe 84 is connected to second supply connector 98. Oil flows from first supply pipe 80, through first supply connector 92, bore 94, chamber 96 and second supply connector 98 and into second supply pipe 84.

Second rotary joint 88 includes a first return connector 100 fixedly mounted on mast 34 with respect to rotation thereof. First pipe connector 100 is in communication with L-shaped bore 102 through a fixed portion of mast 34. L-shaped bore 102 is in communication with annular chamber 104 extending around a portion of mast 34. Annular chamber 104 is in communication with said second supply connector 106 through bore 108. Second supply connector 106 is mounted on mast 34 for rotation therewith. First return pipe 86 is connected to second return connector 106. Oil flows from first return pipe 86, through second return connector 106, bore 108, annular chamber 104, L-shaped bore 102, first return connector 100 and into second return pipe 90. It will be appreciated that the described embodiments of rotary joints 82 and 88 provide the desired connections without interfering with rotation of mast 34.

Figure 7:
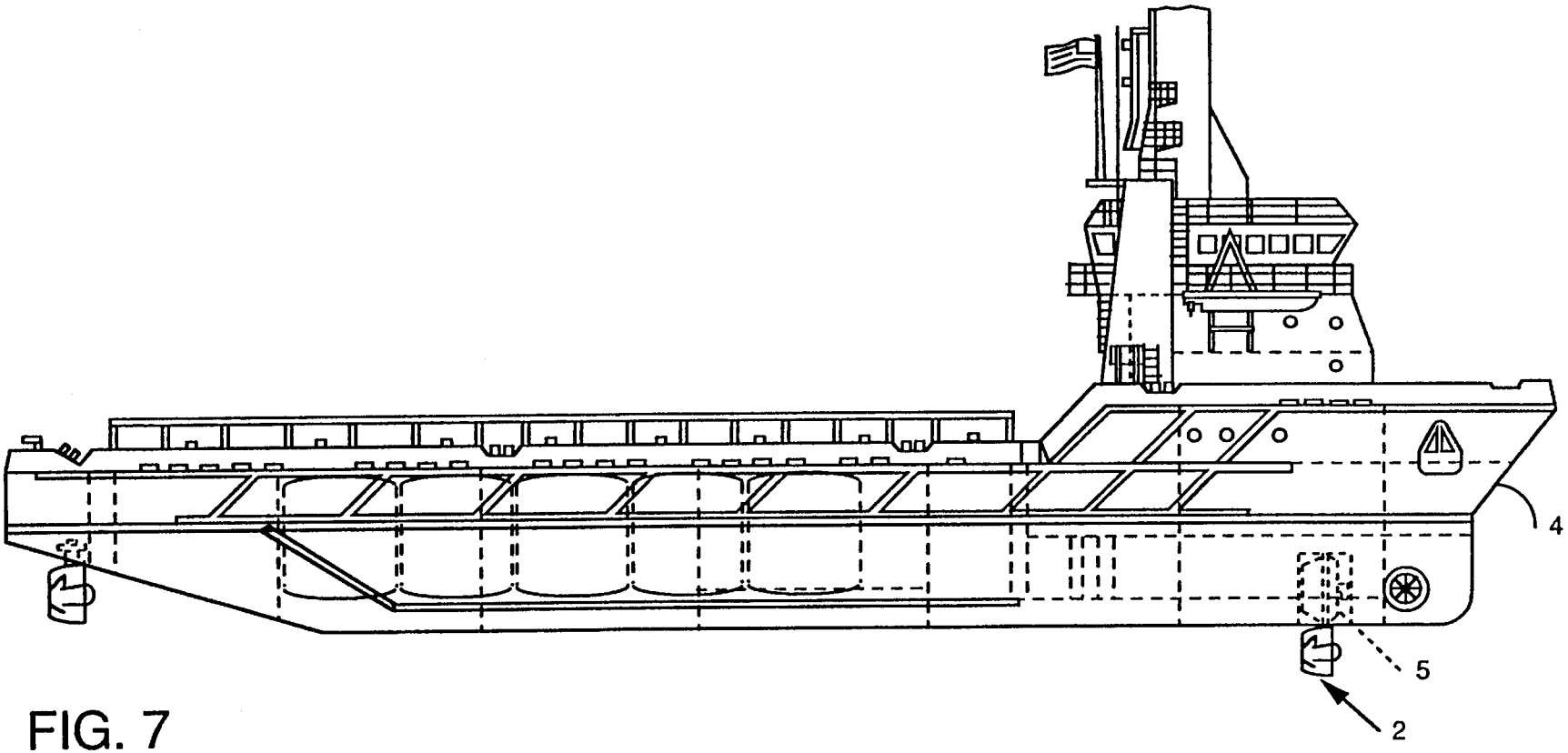
FIG. 7 is a side view of a marine vessel equipped with the auxiliary thruster of this invention.

Referring to FIG. 7, there is shown a marine vessel equipped with the auxiliary thruster 2 of this invention. Auxiliary thruster 2 is shown in the deployed position oriented to direct thrust to propel the vessel forward. The auxiliary thruster is shown in phantom in the retracted position. In the deployed position, the auxiliary thruster operates as an azimuthing thruster to provide thrust in any direction in a plane parallel to the direction of travel of the vessel. To assist more efficiently in maneuvering the vessel, the auxiliary thruster extends below the bottom of the vessel when in the deployed position. If the vessel is in shallow water, or if hazards are present which could be struck by the deployed thruster, the thruster can be retracted into the hull 4 of the vessel.

In a preferred embodiment, the retracted auxiliary thruster can be operated as tunnel thruster to provide lateral maneuvering thrust.

Referring again to FIGS. 1 and 2, hull 4 is provided with transversely extending tunnel 110 extending through recess 5. Tunnel 110 extends all the way through huh 4 below the waterline and is in communication with the water in which the vessel is floating. As shown in FIG. 1, when propulsion unit 6 is fully retracted into recess 5, it is centrally positioned in tunnel 110. Rotation of propeller 16 moves water through tunnel 110 to produce laterally directed thrust. The lateral thrust can be used to assist in maneuvering the vessel during docking and the like. It will be appreciated that reversing the direction of rotation of propeller 16 enables thrust to be produced in either lateral direction. In a preferred embodiment, tunnel 110 is in the bow portion of the vessel, and auxiliary thruster thus operates as a bow thruster. However, it will be appreciated that tunnel 110 could be placed in any desired location in the hull of the vessel.

Because it is an auxiliary thruster, the thruster of this invention will typically be smaller and generate less thrust than the main propulsion unit of the vessel in which it is mounted. However, it will be apparent that the device may be used in virtually any vessel of any size and, thus, may be of any desired size.

It will be appreciated that this invention provides an auxiliary thruster for a marine vessel powered by an integral canned electric motor and operable as an external to the huh azimuthing thruster or an internal to the hull tunnel thruster.

Whereas particular embodiments of this invention have been described for purposes of illustration, it will be evident to those skilled in the art that numerous variations of the details may be made without departing from the invention as described in the appended claims.

We claim:

1. An auxiliary thruster for a marine vessel having a hull, said auxiliary thruster comprising:

a submersible propulsion unit which includes a shroud having a water inlet, a water outlet and a shaft positioned in the center thereof, a propeller means having a hub rotatably mounted within said shroud on said shaft, an electrical motor mounted on said propeller means and said shroud for rotating said propeller means and including a sealed rotor and a sealed stator, said stator being spaced away from and electromagnetically coupled to said rotor, and a bearing assembly between said hub and said shaft to rotatably support said propeller means;

propulsion unit deploying and rotating means mounted to said propulsion unit and to the hull for moving said propulsion unit to extend and retract it out of and into the hull and for rotating said propulsion unit about an axis generally perpendicular to said shaft, to direct thrust in any desired direction in a plane generally parallel to the axis of said shaft said propulsion unit deploying and rotating means including an elongated mast having a first end thereof mounted to a top portion of said shroud so that said mast is generally perpendicular to said shaft and having a second end of said mast extending inside the hull and movably mounted thereto: and energizing means electrically connected to said stator and including at least one pair of electrically connected slip rings mounted on said second end of said mast, the first ring of each said pair of slip rings being electrically connected to an external source of electrical energy and the second ring of,, each said pair of slip rings being electrically connected to said stator through said mast, so as not to impede rotation of said mast.

2. The auxiliary propulsion unit of claim 1, wherein said rotor is mounted around the periphery of said propeller means and said stator is mounted in said shroud.

3. The auxiliary thruster of claim 1, wherein said propulsion unit deploying and rotating means includes at least one yoke mounted to said mast generally perpendicular to the longitudinal axis thereof and slidably mounted to the hull for providing lateral support for said thruster during operation, and at least one power screw mounted on said mast and said hull and positioned generally parallel to said mast so that rotation of said screws moves said mast generally longitudinally.

4. The auxiliary thruster of claim 3, wherein said propulsion unit deploying and rotating means further includes a rotation gear mounted on said second end of said mast and an electrically powered mast rotation gear box having an output gear operatively positioned with respect to said rotation gear so that rotation of said output gear drives said rotation gear.

5. The auxiliary thruster of claim 3, wherein said propulsion unit deploying and rotating means further includes a rotation sprocket mounted on each said power screw, an electrically powered gear box having a drive sprocket thereon, and a drive chain operatively connecting said drive sprocket and said rotation sprocket for synchronously rotating said power screws.

6. The auxiliary thruster of claim 1, wherein at least one vane is connected between said shaft and said shroud for supporting said shaft, wherein said at least one vane is connected between said hub and said outlet end of said shroud.

7. The auxiliary thruster of claim 1, wherein said propulsion unit deploying and rotating means are mounted in a frame, said frame having attachment means thereon for securing said frame to the hull.

8. An auxiliary thruster for a marine vessel having a hull, said auxiliary thruster comprising:

a submersible propulsion unit which includes a shroud having a water inlet, a water outlet and a shaft positioned in the center thereof, a propeller means having a hub rotatably mounted within said shroud on said shaft, an electrical motor mounted on said propeller means and said shroud for rotating said propeller means and including a sealed rotor and a sealed stator, said stator being spaced away from and electromagnetically coupled to said rotor, and an oil cooled bearing assembly between said hub and said shaft to rotatably support said propeller means;

energizing means electrically connected to said stator for supplying electrical current to said stator;

propulsion unit deploying and rotating means mounted to said propulsion unit and to the hull for moving said propulsion unit to extend and retract it out of and into the hull and for rotating said propulsion unit about an axis generally perpendicular to said shaft, to direct thrust in any desired direction in a plane generally parallel to the axis of said shaft, said propulsion unit deploying and rotating means including:

an elongated mast having a first end thereof mounted to a top portion of said shroud so that said mast is generally perpendicular to said shaft and having a second end of said mast extending inside the hull and movably mounted thereto, at least one yoke mounted to said mast generally perpendicular to the longitudinal axis thereof and slidably mounted to the hull for providing lateral support for said thruster during operation, and at least one power screw mounted on said mast and said hull and positioned generally parallel to said mast so that rotation of said screws moves said mast generally longitudinally; and oil supply means including an oil reservoir positioned above said bearing assembly, a first supply pipe connecting said oil reservoir and a rotary joint mounted on said second end of said mast, a second supply pipe connecting said rotary joint and said bearing assembly a first return pipe extending between said bearing assembly and said rotary joint, and a second return pipe extending from said rotary joint and ending in an overflow port positioned at said reservoir, whereby a generally constant head of oil pressure will be maintained in said bearing assembly without restricting rotation of said mast.

9. The auxiliary thruster of claim 8, wherein said rotary joint includes at least one of a swivel connector mounted on said second end of said mast and coaxial therewith, one end of said swivel connector being positioned for rotation with said mast and the other end of said swivel connector being fixed with respect to rotation of said mast; and a first pipe connector mounted on said second end of said mast and fixed with respect to rotation of said mast said first pipe connector being in communication with an annular chamber said chamber further being in communication with a second pipe connector mounted for rotation with said mast.

10. A marine vessel having an auxiliary thruster, said vessel comprising a hull having a waterline and a recess in the bottom thereof below the waterline;

an auxiliary thruster mounted in said recess in said hull, said auxiliary thruster including: a submersible propulsion unit which includes a shroud having a water inlet, a water outlet and a shaft positioned in the center thereof, a propeller means having a hub rotatably mounted within said shroud on said shaft, an electric motor mounted on said propeller means and said shroud for rotating said propeller means and including a sealed rotor and a sealed stator, said stator being spaced away from and electromagnetically coupled to said rotor, and a bearing assembly between said hub and said shaft to rotatably support said propeller means;

propulsion unit deploying and rotating means mounted to said propulsion unit and the hull for moving said propulsion unit to extend and retract it out of and into the hull and for rotating said propulsion unit about an axis generally perpendicular to said shaft, to provide thrust in any desired direction in a plane generally parallel to the axis of said shaft;

said propulsion unit deploying and rotating means including an elongated mast having a first end thereof mounted to a top portion of said shroud so that said mast is generally perpendicular to said shaft and having a second end of said mast extending inside the hull and movably mounted thereto;

energizing means electrically connected to said stator and including at least one pair of electrically connected slip rings mounted on said second end of said mast, the first ring of each said pair of slip rings being electrically connected to an external source of electrical energy and the second ring of each said pair of slip rings being electrically connected to said stator through said mast, so as not to impede rotation of said mast; and control means operatively connected to said auxiliary thruster for extending, retracting, activating, deactivating and steering said auxiliary thruster.

11. The marine vessel of claim 10, wherein said rotor is mounted around the periphery of said propeller means and said stator is mounted in said shroud.

12. The marine vessel of claim 10, wherein said recess in said hull includes a tunnel extending generally transversely through said hull, each end of said tunnel being in communication with the water surrounding said vessel; and said auxiliary thruster being mounted so that when it is retracted into said recess the propulsion unit is positioned in said tunnel so that rotation of said propeller moves water through said tunnel to create thrust to propel the vessel.

13. The marine vessel of claim 11, wherein said propulsion unit deploying and rotating means includes an elongated mast having a first end thereof mounted to a top portion of said shroud so that said mast is generally perpendicular to said shaft and having a second end of said mast extending inside the hull and movably mounted thereto.

14. The marine vessel of claim 12, wherein said tunnel is in the bow portion of the hull thereby forming a bow thruster for maneuvering the bow of the vessel.

15. The marine vessel of claim 12, wherein said tunnel is in the stern portion of the hull thereby forming a stern thruster for maneuvering the stern of the vessel.

16. The marine vessel of claim 12, wherein a frame is mounted on said hull above said recess; and said auxiliary thruster is mounted in said frame.

17. The marine vessel of claim 16, wherein said hull has an opening therein, said mast exits said hull through said opening in said hull, and a floating seal is positioned between said opening and said mast, said floating seal being operable to resist flow of water into said hull and permit extension and retraction of said mast.

18. An auxiliary thruster for a motor vessel having a hull, said auxiliary thruster comprising:

a submersible propulsion unit having electrical motive means mounted therein for generating thrust to propel the vessel;

propulsion unit deploying means mounted to said propulsion unit and to the hull for moving said propulsion unit to extend and retract out of and into the hull and for rotating said propulsion unit to direct thrust in any desired direction, said propulsion unit deploying and rotating means include an elongated mast having a first end thereof mounted to a top portion of said propulsion unit and having a second end of said mast extending inside the hull and movably mounted thereto; and energizing means electrically connected to said stator and including at least one pair of electrically connected slip rings mounted on said second end of said mast, the first ring of each said pair of slip rings being electrically connected to an external source of electrical energy and the second ring of each said pair of slip rings being electrically connected to said stator through said mast, so as not to impede rotation of said mast.

19. The auxiliary thruster of claim 18, wherein said propulsion unit deploying and rotating means include an elongated mast having a first end thereof mounted to a top portion of said propulsion unit and having a second end of said mast extending inside the hull and movably mounted thereto.

20. The auxiliary thruster of claim 19, wherein said propulsion unit deploying and rotating means includes at least one yoke mounted to said mast generally perpendicular to the longitudinal axis thereof and slidably mounted to the hull for providing lateral support for said thruster during operation, and at least one power screw mounted on said mast and said huh and positioned generally parallel to said mast so that rotation of said screws moves said mast generally longitudinally.

21. The auxiliary thruster of claim 20, wherein said propulsion unit deploying and rotating means further includes a rotation gear mounted on said second end of said mast and an electrically powered mast rotation gear box having an output gear operatively positioned with respect to said rotation gear so that rotation of said output gear drives said rotation gear.

22. The auxiliary thruster of claim 18, wherein said propulsion unit deploying and rotating means further includes a rotation sprocket mounted on each said power screw, an electrically powered gear box having a drive sprocket thereon, and a drive chain operatively connecting said drive sprocket and said rotation sprocket for synchronously rotating said power screws.

* * * * *